US007694751B2

(12) United States Patent
Hartke

(10) Patent No.: US 7,694,751 B2
(45) Date of Patent: Apr. 13, 2010

(54) APPARATUS AND METHOD OF LOADING A ROD BOX FOR A HORIZONTAL DIRECTIONAL DRILL

(75) Inventor: Louis C. Hartke, Otley, IA (US)

(73) Assignee: Vermeer Manufacturing Company, Pella, IA (US)

( * ) Notice: Subject to any disclaimer, the term of this patent is extended or adjusted under 35 U.S.C. 154(b) by 107 days.

(21) Appl. No.: 11/827,539

(22) Filed: Jul. 12, 2007

(65) Prior Publication Data

US 2009/0014215 A1 Jan. 15, 2009

(51) Int. Cl.
*E21B 19/14* (2006.01)
*E02D 29/00* (2006.01)

(52) U.S. Cl. ..... 175/52; 175/62

(58) Field of Classification Search ..... 175/51, 175/52, 62, 85, 135, 162, 203
See application file for complete search history.

(56) References Cited

U.S. PATENT DOCUMENTS 5,556,253 A 9/1996 Rozendaal et al.
5,607,280 A * 3/1997 Rozendaal ..... 414/745.7
6,332,502 B1 12/2001 Mills et al.
6,360,830 B1 3/2002 Price
6,374,928 B1 4/2002 Teller et al.
6,474,931 B1 11/2002 Austin et al.
6,474,932 B1 11/2002 Rush
6,533,046 B2 3/2003 Mills et al.
6,543,551 B1 4/2003 Sparks et al.
6,651,755 B1 11/2003 Kelpe
6,814,164 B2 * 11/2004 Mills et al. ..... 175/52
6,845,825 B2 * 1/2005 Bischel et al. ..... 175/24
6,886,644 B2 5/2005 Stump et al.
7,018,164 B2 3/2006 Anthis et al.
7,182,151 B2 2/2007 Stump et al.
7,467,670 B2 * 12/2008 Hartke et al. ..... 175/52
2002/0079137 A1 6/2002 Mills et al.
2002/0153169 A1 * 10/2002 Sewell ..... 175/52
2004/0007388 A1 1/2004 Mills et al.
2005/0199424 A1 9/2005 Stump et al.
2007/0119623 A1 5/2007 Sewell et al.

OTHER PUBLICATIONS

International Search Report and Written Opinion mailed Oct. 24, 2008.

* cited by examiner

*Primary Examiner*—David J Bagnell
*Assistant Examiner*—James G Sayre
(74) *Attorney, Agent, or Firm*—Merchant & Gould P.C.

(57) ABSTRACT

A biased door member is provided in an external wall of a drill rod supply magazine mounted on a horizontal directional drilling (HDD) machine. The door member swings inwardly from a first position parallel to the external wall to a second position within the distal column. At least one cut-out is formed in the external wall at the bottom of the retaining guides located at the longitudinal ends of the magazine. The cut-out creates a window through which the added drill rod is inserted. In operation, a drill rod is moved through the biased door member and window cut-outs into the distal column. The pocket of a rod transfer mechanism is positioned below the last column, and a rod lifter lowers the added drill rod into the pocket. The rod transfer mechanism then moves the added drill rod into alignment with the drill string.

16 Claims, 9 Drawing Sheets

APPARATUS AND METHOD OF LOADING A ROD BOX FOR A HORIZONTAL DIRECTIONAL DRILL

FIELD OF THE INVENTION

The present invention relates generally to equipment used for horizontal ground boring; more specifically to a method and apparatus for manipulating drill rod used in horizontal directional drilling; and more particularly still to a method and apparatus for loading drill rod into a drill rod storage magazine mounted on a horizontal directional drill.

BACKGROUND

Horizontal directional drilling, commonly referred to as HDD, is a process used in applications such as installing utilities underground. Generally the first step in the HDD process includes boring a pilot hole. In this step a bore hole is created that extends underground—generally horizontally or parallel to the surface of the earth—starting at a launch point and ending at a termination point.

The bore hole is created by a boring machine that rotates and pushes a drill string through the ground. A drill bit is attached to the leading end of the drill string. The drill string is formed by connecting individual drill rods together end-to-end. The connection between the rods is made up, and subsequently broken in a later step, by the boring machine. A typical boring machine includes a gearbox that connects to the drill string, a drill rod storage magazine, and a rod loading mechanism. The rod loading mechanism moves the individual drill rods from the storage magazine into alignment with the drill string and the gearbox where the individual drill rod is connected to and made a part of the drill string.

Rod loading mechanisms typically include a rod transfer mechanism that moves the rod from the storage magazine and positions it with one end in alignment with the drill string and the other end in alignment with the gearbox. The drill rods are typically long, and are stored with their longitudinal axes parallel to one another. There are generally several separated, parallel columns in the storage magazine for storing the drill rods, with each subsequent column further from the drill string. Accordingly, the rod loading magazine is generally heavy and bulky.

The drill rod storage magazine may be interchangeable with other magazines. In this type of arrangement, once all of the drill rods stored in a first magazine are used, the empty first magazine can be replaced with a full second magazine. In this manner, a longer drill string may be formed. However, because of the weight of the magazine, special equipment such as a back-hoe, front end loader or other hydraulic equipment capable of lifting the magazine must generally be employed to remove the empty first magazine and replace it with a full second magazine (e.g., the second magazine has an additional supply of drill pipe located therein).

A drawback exists, however, with these systems since there are occasions when only one (or a relatively few) additional drill rods are required for the drill string. Also, there may be instances when the necessary power equipment is not available to lift and replace the magazine. Still further, there may be instances when specific drill pipe is desired to be inserted into the drill string. Therefore, there is a need in the art for a method and apparatus for selectively loading drill rod into a magazine. The present invention overcomes the shortcomings of the prior art and addresses these needs in the art.

SUMMARY

The present invention generally relates to a method and apparatus for loading a drill rod magazine. One aspect of the invention relates to an apparatus and method for loading the drill rod magazine while the magazine is mounted on the HDD boring machine. A second aspect of the invention relates to an apparatus and method for loading drill rod into a drill rod magazine at a point in the magazine that is distal from the drill string. A third aspect of the invention relates to selectively providing individual drill rods from a location external to the magazine for delivery to the drill string by a pipe handling mechanism.

In one embodiment constructed according to the principles of the present invention, there is provided a biased door member in an external wall of the distal most storage column of the magazine. The door member swings inwardly thereby retaining drill rod initially stored in the distal most column and avoiding inadvertent discharge of drill rods through the door member. The door member preferably physically swings from a first position parallel to the external wall to a second position within the last column.

Retaining guides located at each end of the magazine keep the drill rods organized within columns. However, at least one cut-out is formed in the external wall at the bottom of the retaining guide at each end of the magazine. The cut-out creates a window through which added drill rod is inserted into the magazine. In the preferred embodiment, two cut-outs are provided—with one located at each end of the magazine.

Optionally, two or more support arms may be located on the exterior of the external wall of the magazine for supporting drill rod prior to inserting the same into the magazine. In this case, suitable stops may be included at the distal ends of the support arms to retain the drill rod in position.

In operation, a drill rod is placed onto the support arm in anticipation of loading a drill rod into the magazine. The drill rod is then moved through the biased door member into the last column of the magazine. The ends of the added drill rod fit through the window cut-outs. The pocket of the rod transfer mechanism is positioned below the last column, and a rod lifter lowers the added drill rod into the pocket. The rod transfer mechanism then moves the added drill rod into alignment with the drill string.

Therefore, according to one aspect of the invention, there is provided a horizontal directional drilling machine, comprising: a boring assembly defining a drill string axis comprising a rack frame with an upper end and a lower end, a gearbox configured to travel along the rack frame from the upper end to the lower end, and a vise assembly at the lower end; a drill rod storage magazine mounted on the horizontal directional drilling machine and adjacent the boring assembly, the storage magazine including a plurality of columns defined by retaining guides located at opposing ends of the storage magazine, and further including a biased member located on an external wall of the storage magazine distal to the drill string through which drill rod is selectively loaded; and a pair of drill pipe transfer mechanisms configured to transfer drill pipe from the storage magazine to drill string.

According to another aspect of the invention, there is provided a drill rod storage magazine, the magazine comprising: a supporting structure; a plurality of columns defined within the supporting structure by retaining guides located at opposing ends of the supporting structure; and a plurality of biased members located on an external wall of the supporting structure through which drill rod is selectively loaded.

According to yet another aspect of the invention, there is provided a method for selectively loading drill rod into a storage magazine of a horizontal directional drill machine, the method comprising: pivotally mounting a plurality of biased members onto an external wall of a storage magazine located on the directional drill machine, the storage magazine including retaining guides located at opposing ends of the storage magazine to form storage columns; forming at least one window into at least one of the retaining guides through which drill rod can be inserted into the column formed by the respective retaining guides; and loading drill rod through the biased members and windows into the magazine.

While the invention will be described with respect to preferred embodiment configurations and with respect to particular devices used therein, it will be understood that the invention is not to be construed as limited in any manner by either such configuration or components described herein. Also, while particular types of transfer mechanisms and storage magazines are described herein, it will be understood that such particular mechanisms and magazines are not to be construed in a limiting manner. Instead, the principles of this invention extend to any environment in which selective loading of a drill rod magazine is desired. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

DETAILED DESCRIPTION

Reference will now be made in detail to exemplary aspects of the present invention which are illustrated in the accompanying drawings. Wherever possible, the same reference numbers are used throughout the drawings to refer to the same or like parts. In order to more clearly describe the invention, a description of the magazine loading method and apparatus will be deferred pending a brief overview of a typical horizontal directional drill and a transfer member for moving drill rod from a magazine to the drill string (and vice versa).

Figure 1:
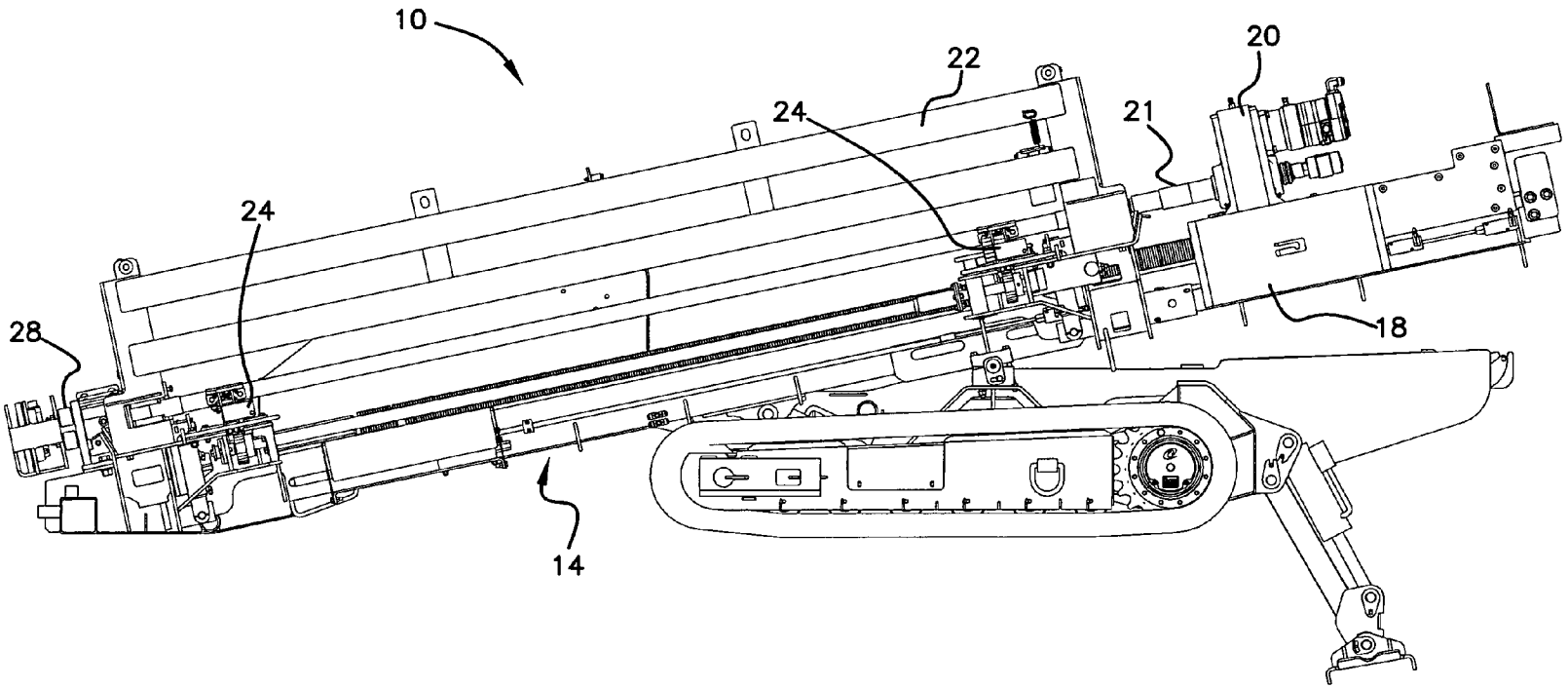
FIG. 1 is an elevated side plan view illustrating the basic components of a horizontal directional drill device including a magazine constructed in accordance with the principles of the present invention.

FIG. 1 illustrates a typical horizontal directional drill 10 including a main frame 14, a rack frame 18, a gearbox 20 that is arranged and configured to move back and forth along the longitudinal axis of the rack frame. Spindle 21 can be independently rotated clockwise or counterclockwise. A rod magazine 22 located generally above and to the side of the rack frame stores drill rods. Pipe transfer mechanism is arranged and configured to move the drill rod from the magazine 22 to a position in line with the drill string. A vise assembly 28 is located at the opposing end of the horizontal directional drill 10 from the gearbox 20. Accordingly, in operation, the pipe transfer mechanism 24 supports and transfers individual drill rod from the magazine 22 and into alignment with the drill string 23 (best seen in FIG. 2) and spindle 21 of gearbox 20.

While not specifically shown, it will be appreciated that an operator console, controls, and a prime mover are also included as part of the horizontal directional drill 10, as well as other well known components that operate in their customary and known manner. Further, it will be appreciated that the drill rod may be referred to herein as both drill rod and drill pipe. Such terms are used interchangeably herein and are not meant to denote a different type or work piece or structure. Still further, as used herein, the term lower refers to a position closer/nearer to the surface of the ground, while upper refers to a position that is relatively further from the ground.

Figure 2:
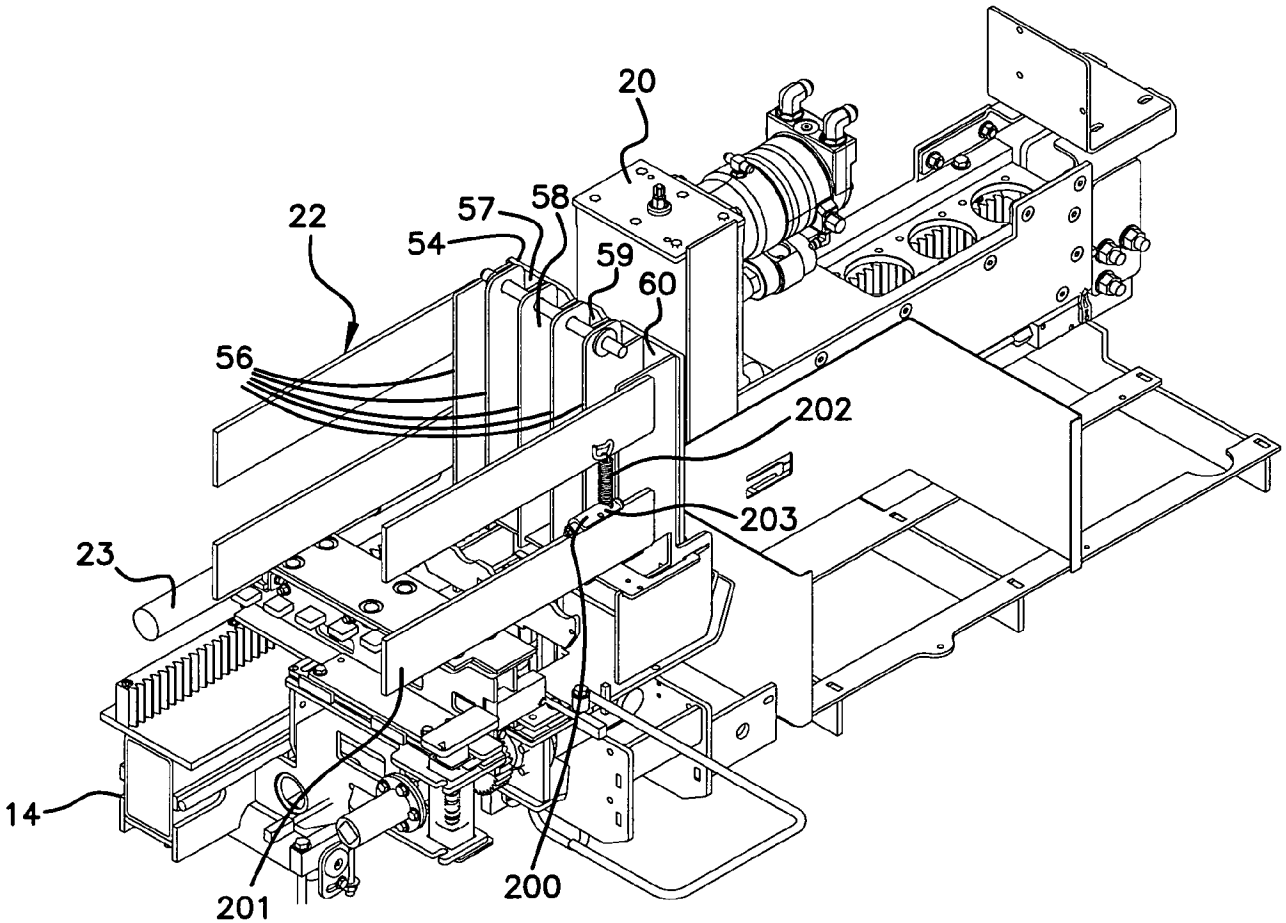
FIG. 2 is a first perspective partial view of a portion of the horizontal directional drilling machine and the magazine illustrating the location of the bias members, windows, and transfer mechanism.
Figure 3:
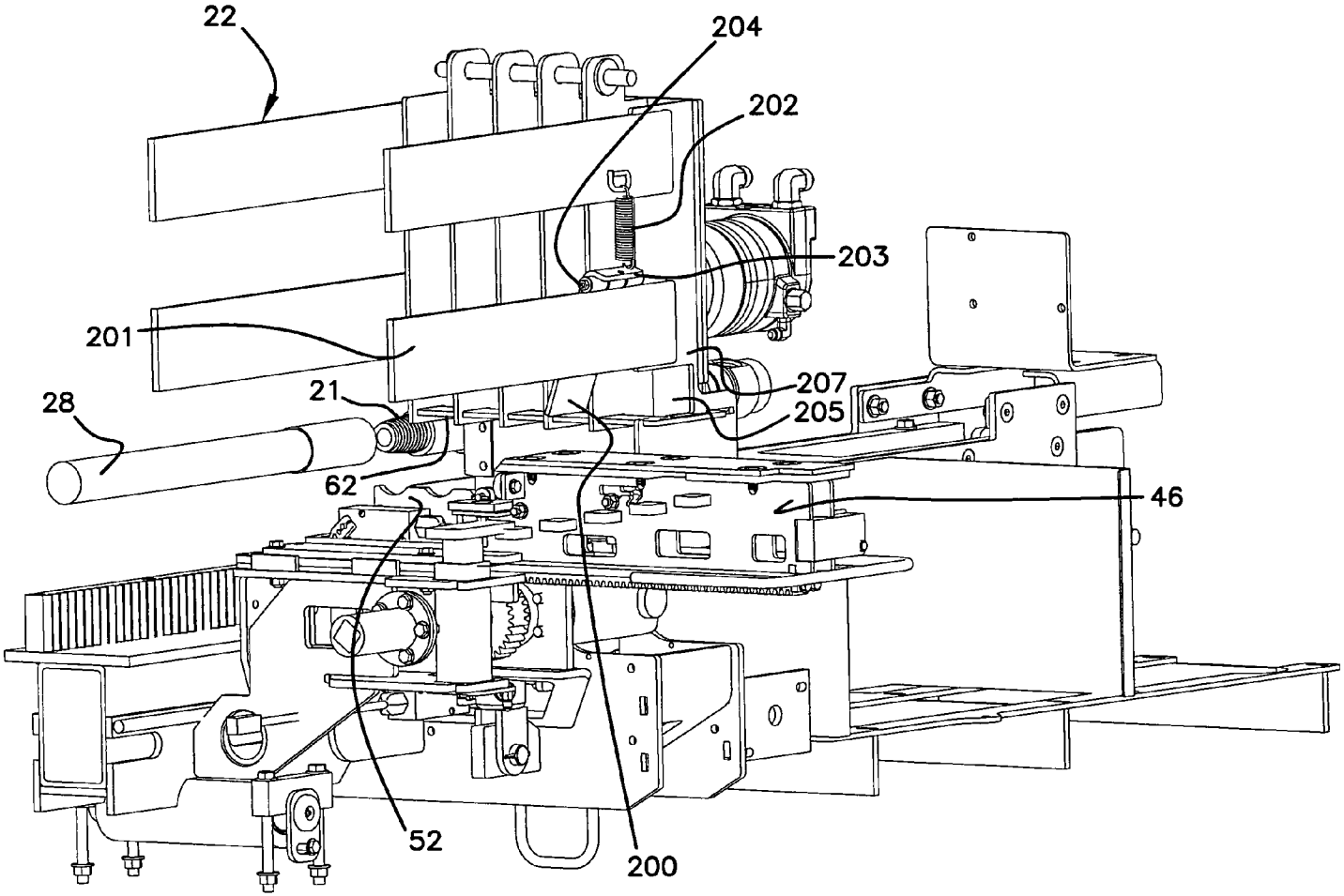
FIG. 3 is a second perspective partial view of the magazine and the horizontal directional drilling device.

Referring now to FIGS. 1, 2 and 3, the magazine 22 of the drilling apparatus 10 includes a box-shaped frame 54 having a plurality of retaining members 56. The members 56 divide the magazine 22 into a plurality of columns 56-60. The column 56 nearest the drill string 23 is referred to as a first or proximal column. The column 60 farthest from the drill string 23 is referred to as an end or distal column. Each of the columns 57-60 may contain a plurality of pipes (e.g., best seen in FIG. 4*a*) with the pipes aligned vertically within each of the columns 56-60 and with the pipe axes parallel to the drive axis of the drill string 23. The columns 56-60 each physically have a width approximately equal to the width of one of the pipes 28 (best seen in FIG. 4*a*).

Now referring to FIG. 3, the magazine 22 has a bottom end 62 that is open such that the spaces between the retaining members 56 define a plurality of discharge openings. In a preferred embodiment, the drill rod or pipes 28 are gravity discharged through the openings.

In the example shown, the magazine 22 has five columns each containing a plurality of pipes. It will be appreciated that the magazine 22 can be provided with more or fewer columns and with more or fewer pipes per column. Also, the magazine 22 can be configured such that the columns are adapted to discharge pipes through a single discharge opening. Consequently, separate discharge openings are not required for each column. Additionally, the magazine can be configured to define a single open bin for holding pipes, and one or more discharge openings to enable pipes to be removed from the bin. Furthermore, non-gravity feed magazines can also be used.

Figure 4A:
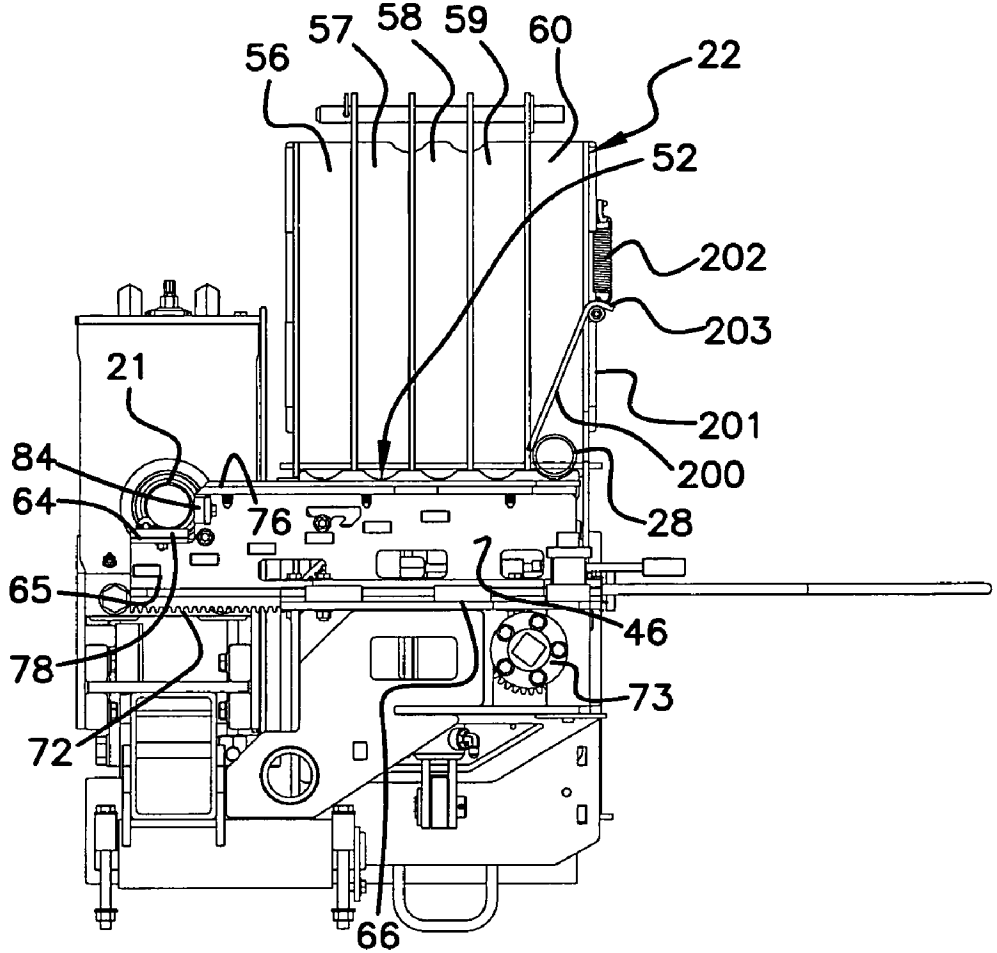
FIGS. 4*a*-4*d* are a schematic cross-section view illustrating the operation of a biased member, rod lifter and blocking mechanism.
Figure 4B:
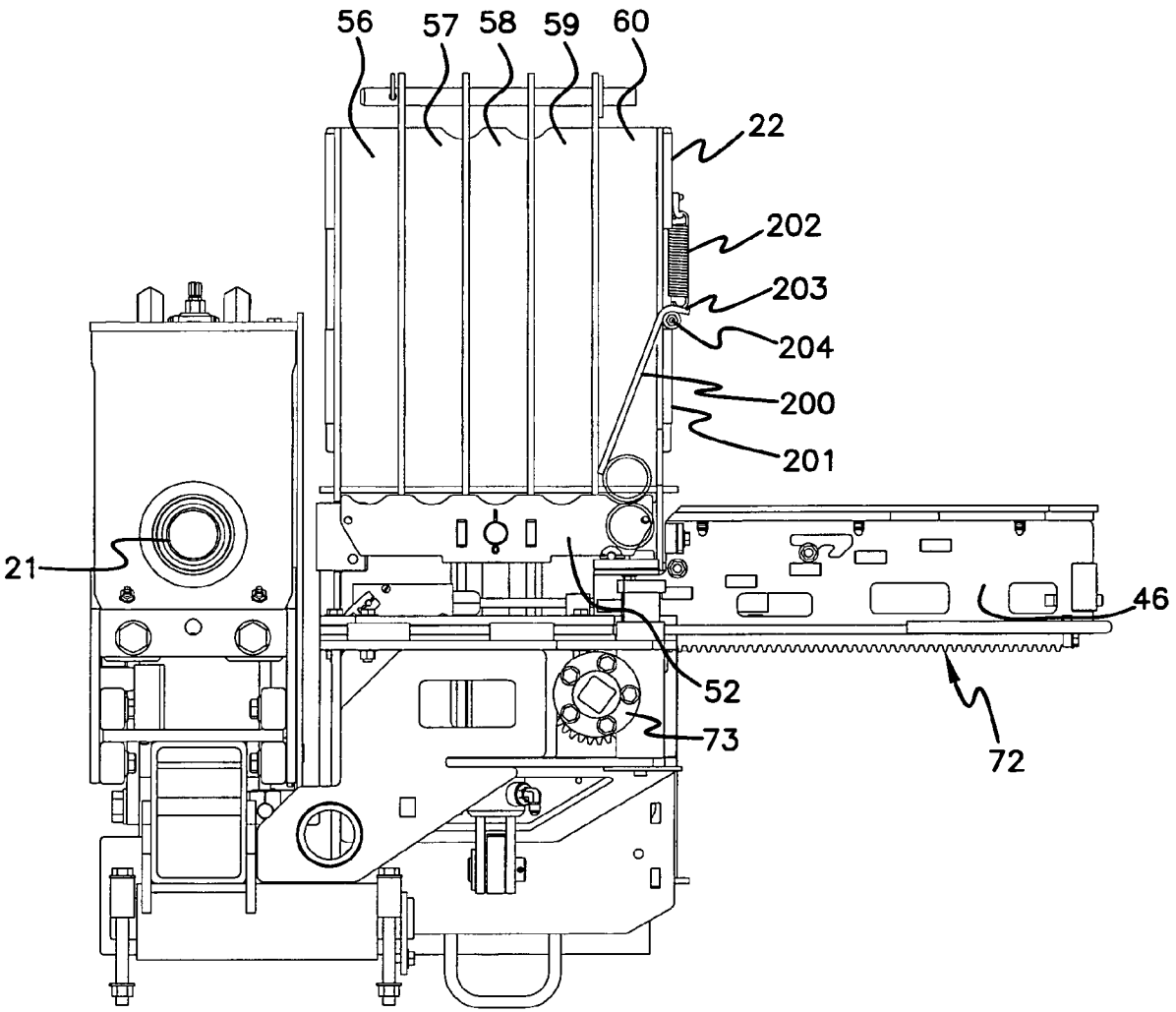

As previously noted, two transfer members 46 are used to convey pipes between the magazine 22 and the drill string 23. As shown in FIG. 3, the drill string 23 is coaxial with the drill rod 28 and the spindle 21. The pipe transfer members 46 each have substantially identical configurations and are simultaneously moved between a retracted orientation (e.g., as shown in FIG. 4*b*) and an extended orientation (shown in FIG. 4*a*).

In FIGS. 4*a*-4*d*, only one of the pipe transfer members 46 is shown. The illustrated pipe transfer member 46 includes a pipe receiving region 64 positioned at an end 65 of the pipe transfer member that is closest or proximal to the drill string 23. When the pipe transfer member 46 is in the retracted orientation of FIG. 4*b*, the pipe receiving region 64 is preferably located beneath the magazine 22 (e.g., directly beneath a selected one of the magazine storage columns and associated discharge opening). By contrast, when the pipe transfer member 46 is in the extended orientation of FIG. 4*a*, the pipe receiving region 64 is positioned at the drive axis of the drill string 23. As so positioned, a pipe held within the pipe receiving region 64 is preferably placed in coaxial alignment with the drill string axis.

As shown in FIGS. 4*a*-4*d*, the pipe transfer member 46 is slidably mounted on a lower track 66. A gear rack 72 is secured to the bottom of the pipe transfer member 46. The gear rack 72 fits within an elongated slot defined by the track 66. The rack 72 cooperates with a drive gear 73, such as a pinion gear driven by a hydraulic motor, to move the pipe transfer member 46 between the extended and retracted orientations.

Referring still to FIGS. 4*a*-4*d*, the pipe transfer member 46 includes a top pipe retaining surface 76 that is used to block the discharge openings. The retaining surface 76 prevents pipes from being discharged from the columns 56-60 when such columns contain pipes, and the pipe receiving region 64 of the pipe transfer member 46 is not positioned below a selected one of the columns 57-60. The pipe transfer member 46 also includes a lower platform 78 that is recessed relative to the pipe retaining surface 76. Both the lower platform 78 and the pipe retaining surface 76 are covered by wear strips preferably made of a suitable plastic-type material.

The lower platform 78 is positioned at the end 65 of the pipe transfer member 46 that is closest to the drill string 23. Referring to FIG. 4*a*, the lower platform 78 includes a top surface 82 that is aligned generally along a horizontal plane. The pipe transfer member 46 also includes an upright wall 84 positioned adjacent the pipe receiving region 64. The lower platform 78 and the upright wall 84 cooperate to define a partial pocket at the pipe receiving region 64.

To unload a pipe from the first column 57 of the magazine 26, the pipe transfer members 46 are moved to the retracted position such that the pipe receiving regions 64 are located directly beneath the appropriate discharge opening. With the pipe transfer members 46 so positioned, pipe lifts 52 are lowered causing the lower most pipe in the first column 56 to move through the discharge opening into the pipe receiving regions 64. The pipe retaining surfaces 76 of the pipe transfer members 46 prevent any other pipes from being discharged through any of the other discharge openings.

After the pipe has been loaded into the pipe receiving regions 64, the pipe transfer members 46 are moved toward the extended orientation. As the pipe receiving regions 64 move from beneath the magazine 22, devices which help retain and guide the pipe into the drill string axis may be implemented. For example, assist arms (not shown) may move and/or magnets (if any) may be activated. The magnetic attraction provided by the magnets resists lateral movement of the pipe within the partial pockets of the pipe transfer members 46 thereby inhibiting the pipe from falling out of the partial pockets during transfer of the pipe. The magnets also inhibit the pipe from sliding along its axis as the pipe is transferred. For example, during drilling operations, the track 30 and magazine 26 are commonly inclined. Therefore, the pipe may have a tendency to slide downward along its axis unless somehow restrained.

With the pipe aligned with the drill string 23 axis, the spindle 21 of the drive head 20 can be threaded into the pipe, and the pipe can be drilled into the ground. After the pipe has been coupled to the spindle 21, the pipe transfer members 46 are preferably retracted. Hence, the pipe is laterally displaced from the pipe receiving regions 64 as the pipe transfer members 46 are retracted. The pipe transfer members 46 are then moved back to a retracted position such that another pipe from the first column 56 can be loaded into the pipe receiving regions 64.

In unloading the magazine 22, the sequence of steps described above are repeated until all of the pipes contained in the first column 56 have been selected. Thereafter, the same procedure is repeated with respect to the second column 57, the third column 58, the fourth column 59, and the fifth column 60 until all of the pipes from the magazine 22 have been selected.

To load the magazine, the pipe transfer members 46 are extended to receive a pipe from the drill string 23 and the pipe is uncoupled from the spindle 21 and other pipes in the drill string. The uncoupled pipe is loaded into the pipe receiving pocket 64 of the pipe transfer members 46. With the pipe so oriented, the pipe transfer members 64 are moved from the extended orientation toward the retracted orientation. The pipe transfer members 46 are then oriented such that the pipe receiving regions 64 are positioned beneath the fifth column 60. Next, the pipe lifts 52 are used to lift the pipe from the pipe receiving regions 64, through the discharge opening and into the fifth column 60. The pipe transfer members 46 are then moved back to the extended orientation to receive another pipe from the drill string 23, and the pipe lifts 52 are lowered. Thereafter, the sequence is repeated until the fifth column 60 has been filled. After the fifth column 60 has been filled, the same process is repeated with respect to the fourth column 59, the third column 58, the second column 57 and the first column 56 until the entire magazine 22 has been filled.

It will be appreciated that the loading and unloading sequences will depend upon the particular magazine configuration being used. Consequently, the disclosed unloading and loading cycles are being provided as examples that are not intended to limit the scope of the present invention For example, in one alternate embodiment, individual, separately actuated pipe stops can be used at each of the discharge openings. For such an embodiment, pipes can be loaded into or unloaded from any of the columns 56-60 at any given time. Therefore, any type of loading or unloading sequence can be used (i.e., the columns can be loaded or unloaded in any order or even randomly).

For those wishing a more detailed discussion of the construction and operation of pipe transfer mechanisms 46, reference may be had, for example, to U.S. Pat. No. 6,332,502, with such patent being incorporated herein and made a part hereof by reference.

Returning now to FIG. 2 and the description of a preferred magazine loading method and apparatus, a biased member 200 is shown as hinged on top of the external wall 201 of the storage magazine 22. Preferably, the external wall 201 is that wall that is most distal from the drill string 23. A spring 202 is connected between a flange 203 of the biased member 200 so as to rotate the biased member 200 about the hinge 204. The spring 203 normally biases the biased member 200 into a first position where it is flush or generally adjacent to the mean plane formed by the external wall 201. In this position, the biased member closes the opening into the storage magazine 22. This position results in drill rod in distal column 60 helping urge biased member 200 against the external wall 201—thereby retaining the drill rod within the magazine 22.

In FIG. 3, the biased member 200 is shown in an open position with the spring 202, the flange 203 and the hinge 204. The pipe transfer mechanism 46, however, is in a retracted position and the pipe lifting arms 52 are lowered. Also shown is a section of drill rod 28 in line with the drill string 23. Cut-out 205 is shown in the external guide member 207 at the lower end of the magazine 22. The cut-out 205 forms a window through which drill rod may be selectively loaded into the magazine 22.

Turning now to FIGS. 4*a*-4*d*, a schematic cross-section view is illustrated looking toward the up-hill end of the horizontal directional drill 10. In FIG. 4*a*, the transfer mechanism 46 is shown in the extended position. In this position it would normally block all of the columns 56-60 of the magazine 22 while delivering a drill rod to the drill string 23. Still referring to FIG. 4*a*, the biased member 200 is shown in the open or second position where it is rotated so that it extends into the magazine 22, and more specifically within the distal column 60. In this position, drill rod 28 may be placed into the magazine 22 within the distal column 60. As noted above, a window 205 is sized and defined in the guide member 207 of the magazine 22.

Figure 6:
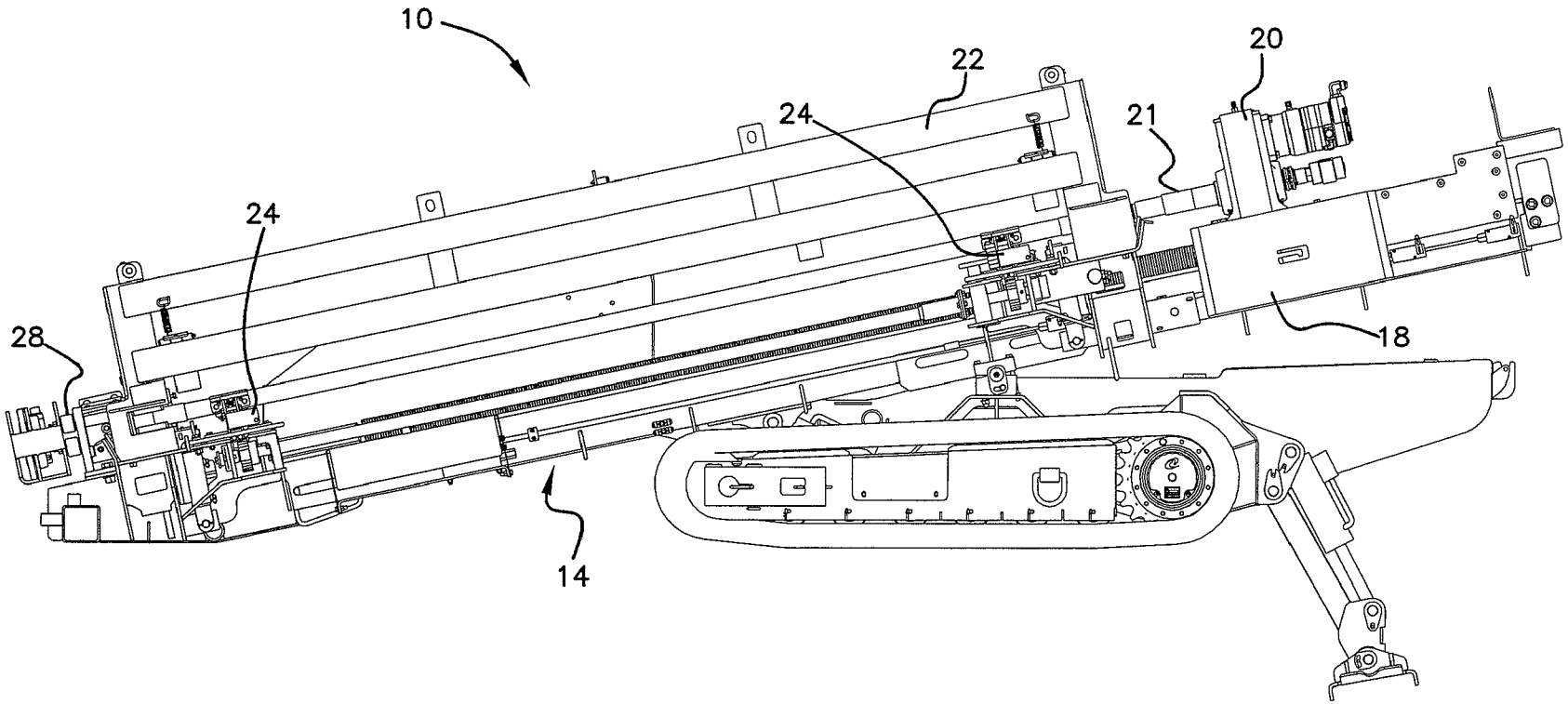
FIG. 6 is an elevated side plan view of an embodiment of a horizontal directional drill device according to the principles of the present invention.

It will be appreciated that if drill rods are located in the distal column 60, then the biased member 200 cannot be opened. It will be further appreciated that while only one biased member 200 is shown in FIG. 1, a second biased member may also located at the opposing end of the magazine 22 (best seen in FIG. 6). The biased member 200 is thereby comprised of a plurality of doors though which the drill rod is selectively inserted. Still further, additional biased members may be included at intermediate positions of the magazine 22. The biased members 22 may be constructed of steel, rigid plastic, and other metals and materials which are suitable for withstanding the forces exerted by a column of drill rods.

A single window 205 may be provided at one end of the magazine or, alternatively, a second window may be provided at the opposite end of the magazine. In the case where a single window is provided, the drill rod 28 can be first inserted into the down-hill end of the magazine 22 by stabbing one end into distal column 60. That end becomes a fixed end. The opposing end (or free end) of drill rod 28 can then be rotated into the magazine 22 through the biased members 200 and the window 205. It will be appreciated that the single window 205 may also be formed in the down-hill end of the magazine. In the case of two windows 205, such windows are preferably formed in opposing ends of the magazine such that drill rod 28 can be placed within the magazine without rotating the drill rod 28. Accordingly, such windows 205 are preferably arranged and configured to have an opening of at least the outer diameter of the drill rod 28 and to be spaced apart from one another to accommodate the length of the drill rod 28.

Figure 4C:
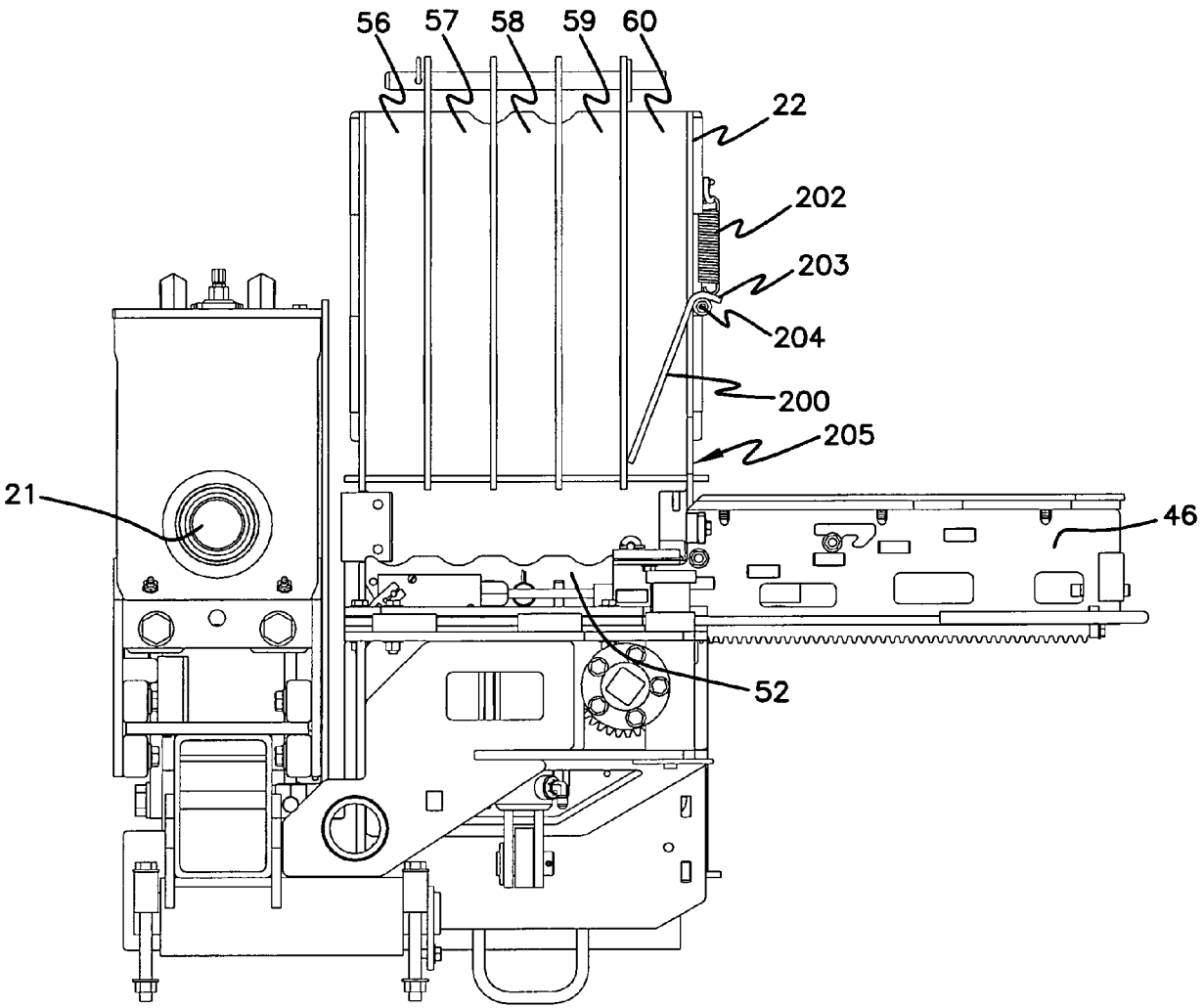
Figure 4D:
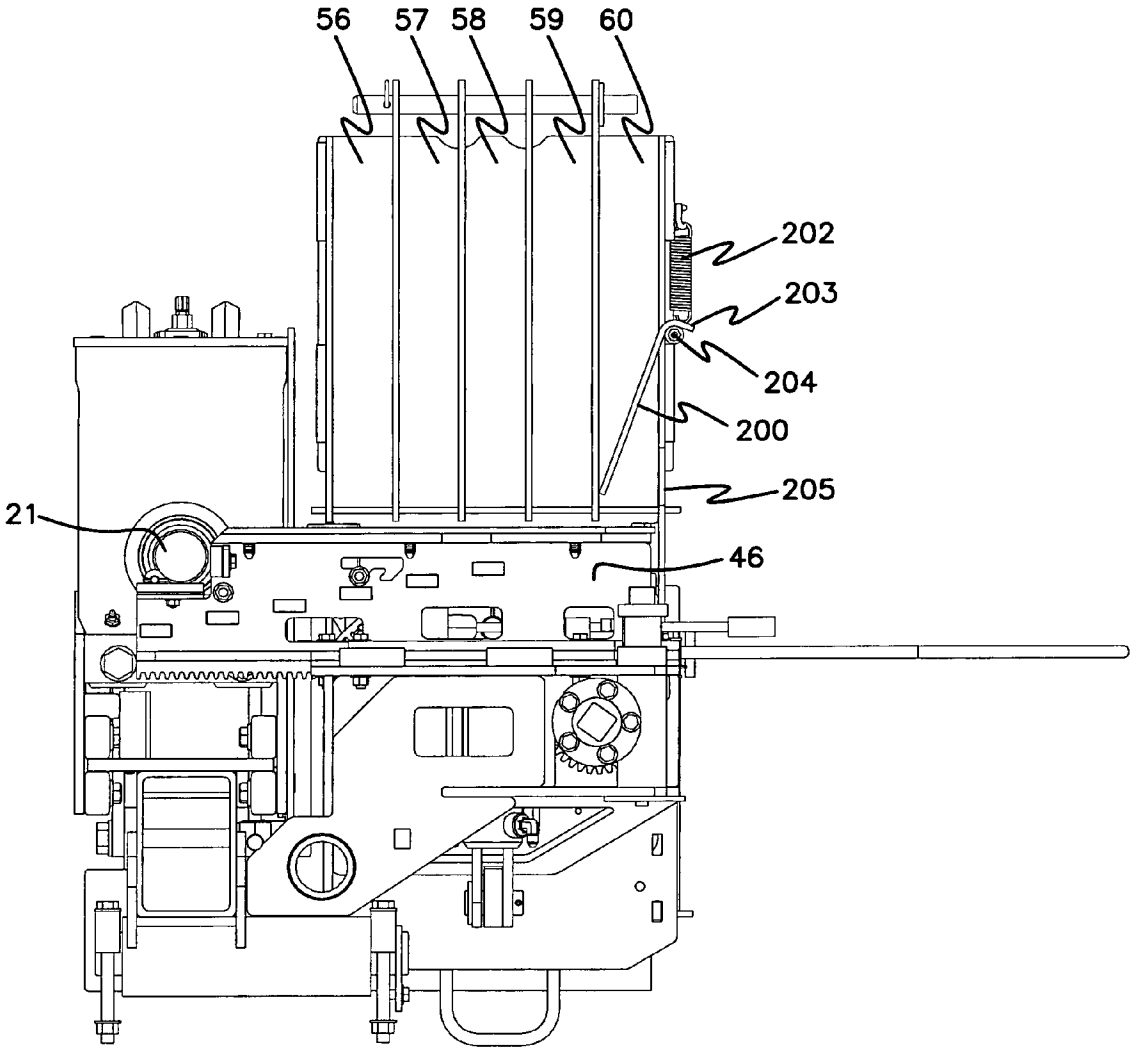

FIG. 4*b* illustrates the transfer mechanism 46 in a retracted position. When the pipe lifting arms 52 are lowered, the inserted drill rod 28 will be lowered into the receiving pocket 64 of the transfer mechanism 46. Subsequently, the inserted drill rod 28 can be transferred to the drill string 23. FIG. 4*c* shows the pipe lifting arms 52 lowered, the biased member 200 in the second position and the transfer mechanism 46 in its retracted position. FIG. 4*d* illustrates the transfer mechanism in its extended position with the biased member open.

Figure 5:
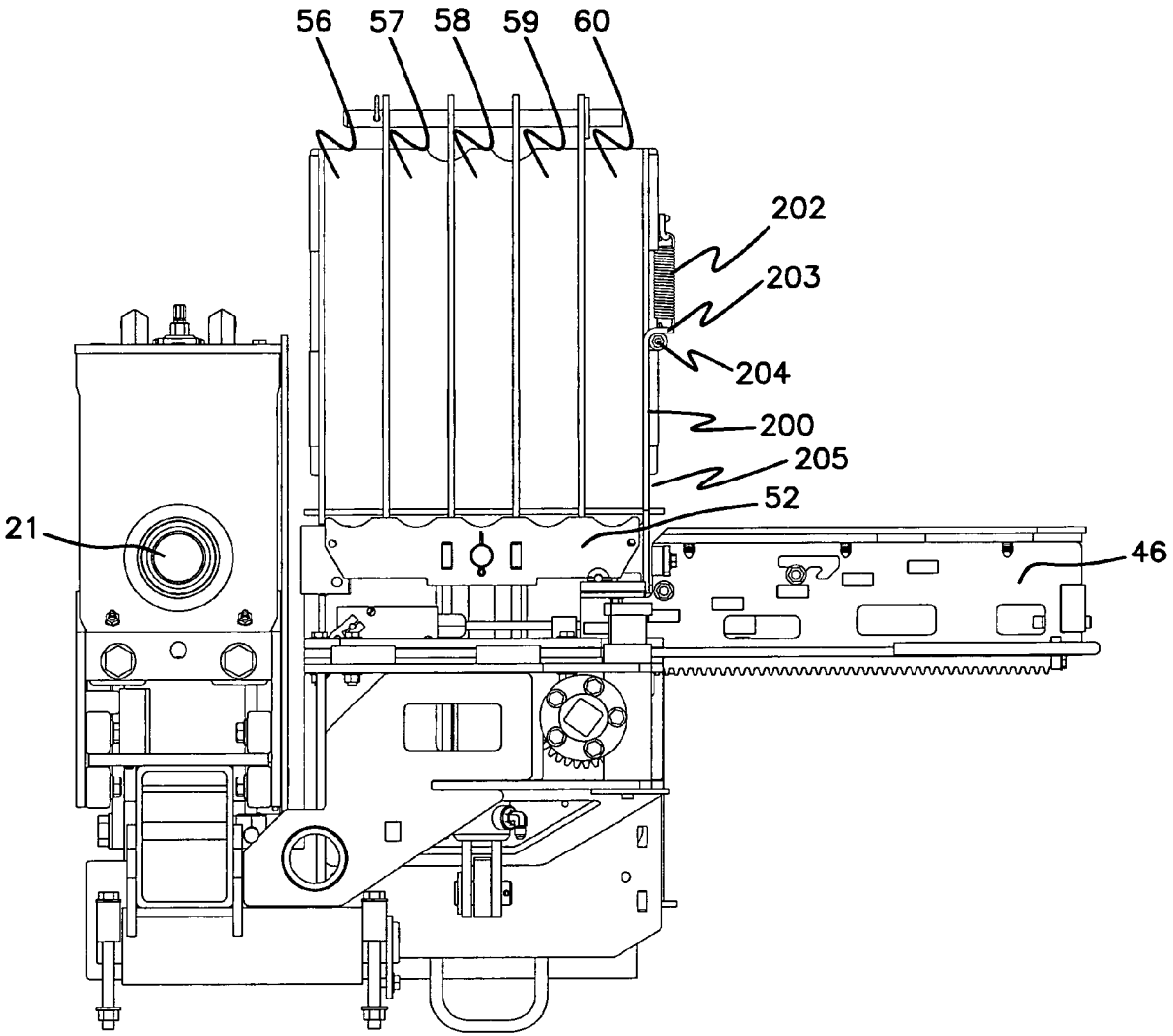
FIG. 5 schematically illustrates the biased member in the shut or first position.

FIG. 5 illustrates the transfer mechanism 46 in the retracted position, the pipe lifting arms 52 in an upward position, and the biased member 200 in a closed or a first position.

Drill rod 28 may also be selectively removed from the magazine 22 during the process of moving drill rods from the drill string 23 into the magazine 22.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefor other than as described herein can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. A horizontal directional drilling machine, comprising:

a) a boring assembly defining a drill string axis comprising a rack frame with an upper end and a lower end, a gearbox configured to travel along the rack frame from the upper end to the lower end, and a vise assembly at the lower end;

b) a drill rod storage magazine mounted on the horizontal directional drilling machine and adjacent the boring assembly, the storage magazine including a plurality of columns between a first side wall and an opposed second side wall, wherein the first side wall is farther from the drill string axis than the second side wall and wherein the drill rod storage magazine includes a biased member located on the first side wall of the storage magazine through which drill rod can be selectively loaded; and c) a pair of drill pipe transfer mechanisms configured to transfer drill pipe from the storage magazine to drill string.

2. The horizontal directional drilling machine of claim 1, wherein a windows is formed in a lower portion of the first side wall.

3. The horizontal directional drilling machine of claim 1, wherein the biased member includes two doors located on opposing ends of the storage magazine.

4. The horizontal directional drilling machine of claim 3, wherein the two doors have a first position that is generally coplanar with the first wall and a second position in the interior of the storage magazine.

5. The horizontal directional drilling machine of claim 4, wherein the doors are configured to pivot and are normally biased into the first position and engage a portion of the first wall to prohibit further rotation, whereby drill rod stored in the column adjacent the first wall is retained within the storage magazine.

6. The horizontal directional drilling machine of claim 1, further including opposing support arms extending normally away from the storage magazine, the support arms located proximate the biased member.

7. The horizontal directional drilling machine of claim 1, wherein the biased members is constructed of steel.

8. The horizontal directional drilling machine of claim 1, wherein the biased member is a door that is held closed by a spring, wherein the door is located closer to the upper end of the rack frame than the lower end of the rack frame.

9. The horizontal directional drilling machine of claim 8, wherein the first wall includes vertical retaining guides located at opposed ends of the storage magazine and wherein a windows is formed in a lower portion of one of the retaining guides adjacent the door.

10. A drill rod storage magazine, the magazine comprising:

a) a supporting structure;

b) a plurality of columns defined within the supporting structure by retaining guides located at opposing ends of the supporting structure; and c) biased members-located on an external side wall of the supporting structure through which drill rod can be manually loaded.

11. The drill rod storage magazine of claim 10, wherein the retaining guides include at least one window defined therein.

12. The drill rod storage magazine of claim 11, wherein the window is located in a retaining guide at a first end of the supporting structure.

13. The drill rod storage magazine of claim 12, wherein the window is sized and configured to allow drill rod into in the supporting structure though the biased member.

14. The drill rod storage magazine of claim 13, wherein the retaining guide includes two windows at opposite ends of the supporting structure.

15. The drill rod storage magazine of claim 10, wherein the supporting structure is arranged and configured to have a length approximately corresponding to the physical distance of the length of the drill rod.

16. A method for manually loading drill rod into a storage magazine of a horizontal directional drill machine, the method comprising:

a) pivotally mounting a plurality of biased members onto an external wall of a storage magazine located on the directional drill machine, the storage magazine including retaining guides located at opposing ends of the storage magazine to form storage columns;

b) forming at least one window into at least one of the retaining guides though which drill rod can be manually inserted into the column formed by the respective retaining guides; and c) manually loading drill rod though the biased members and window into the magazine.

* * * * *

UNITED STATES PATENT AND TRADEMARK OFFICE

CERTIFICATE OF CORRECTION

PATENT NO. : 7,694,751 B2
APPLICATION NO. : 11/827539
DATED : April 13, 2010
INVENTOR(S) : Louis C. Hartke It is certified that error appears in the above-identified patent and that said Letters Patent is hereby corrected as shown below:

Col. 7, line 26: “though” should read --through--

Col. 8, line 52: “members” should read --member--

Col. 8, line 61: “windows” should read --window--

Col. 9, line 1: “biased members-located” should read --a biased member located--

Signed and Sealed this

Seventh Day of September, 2010

David J. Kappos

David J. Kappos
*Director of the United States Patent and Trademark Office*